US009285718B2

(12) United States Patent
Hara et al.

(10) Patent No.: US 9,285,718 B2
(45) **Date of Patent: *Mar. 15, 2016**

(54) IMAGE FORMING APPARATUS INCLUDING A FIRST TRANSFER SECTION USING TONER CONTAINING FLAT METALLIC PIGMENT PARTICLES AND SECOND TRANSFER SECTION USING TONER NOT CONTAINING FLAT METALLIC PIGMENT PARTICLES

(71) Applicant: FUJI XEROX CO., LTD., Minato-ku, Tokyo (JP)

(72) Inventors: Toko Hara, Kanagawa (JP); Takaharu Nakajima, Kanagawa (JP); Miho Ikeda, Kanagawa (JP); Aya Kakishima, Kanagawa (JP); Koichiro Yuasa, Kanagawa (JP); Yasumitsu Harashima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/476,145

(22) Filed: Sep. 3, 2014

(65) Prior Publication Data

US 2015/0205229 A1 Jul. 23, 2015

(30) Foreign Application Priority Data

Jan. 23, 2014 (JP) ..... 2014-010724

(51) Int. Cl.
*G03G 15/16* (2006.01)
*G03G 15/20* (2006.01)

(52) U.S. Cl.
CPC ..... *G03G 15/1605* (2013.01); *G03G 15/162* (2013.01); *G03G 15/1675* (2013.01)

(58) Field of Classification Search
CPC ..... G03G 15/1675; G03G 15/163; G03G 15/1625; G03G 15/167
USPC ..... 399/66, 314
See application file for complete search history.

(56) References Cited

U.S. PATENT DOCUMENTS

2004/0037573 A1* 2/2004 Hirota et al. ..... 399/12
2015/0016851 A1* 1/2015 Shigezaki et al. ..... 399/314

FOREIGN PATENT DOCUMENTS

JP 2002229293 A * 8/2002 ..... G03G 15/01
JP 2006-317632 A 11/2006
JP 2006-317633 A 11/2006

* cited by examiner

*Primary Examiner* — Billy Lactaoen
(74) *Attorney, Agent, or Firm* — Sughrue Mion, PLLC

(57) ABSTRACT

An image forming apparatus includes an endless transfer member, a first transfer section, a second transfer section, and a medium transfer section. An image is transferred to the transfer member during circulation of the transfer member. The first transfer section forms an image using a toner containing flat metallic pigment particles, and transfers the formed image to the transfer member through a transfer current. The second transfer section forms an image using a toner not containing flat metallic pigment particles, and transfers the formed image to the transfer member through a transfer current. The second transfer section is disposed upstream of the first transfer section in a circulation direction of the transfer member. The medium transfer section transfers the image transferred to the transfer member to a recording medium through a transfer current. The transfer current for the first transfer section is smaller than that for the second transfer section.

2 Claims, 8 Drawing Sheets

IMAGE FORMING APPARATUS INCLUDING A FIRST TRANSFER SECTION USING TONER CONTAINING FLAT METALLIC PIGMENT PARTICLES AND SECOND TRANSFER SECTION USING TONER NOT CONTAINING FLAT METALLIC PIGMENT PARTICLES

CROSS-REFERENCE TO RELATED APPLICATIONS

This application is based on and claims priority under 35 USC 119 from Japanese Patent Application No. 2014-010724 filed Jan. 23, 2014.

BACKGROUND

Technical Field

The present invention relates to an image forming apparatus.

SUMMARY

According to an aspect of the present invention, there is provided an image forming apparatus including: an endless transfer member to which an image is transferred during circulation of the transfer member; a first transfer section that forms an image using a toner containing flat metallic pigment particles, and that transfers the formed image to the transfer member through a transfer current; a second transfer section that forms an image using a toner not containing flat metallic pigment particles, and that transfers the formed image to the transfer member through a transfer current, the second transfer section being disposed upstream of the first transfer section in a circulation direction of the transfer member; and a medium transfer section that transfers the image transferred to the transfer member to a recording medium through a transfer current, in which the transfer current for the first transfer section is smaller than the transfer current for the second transfer section.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1A:
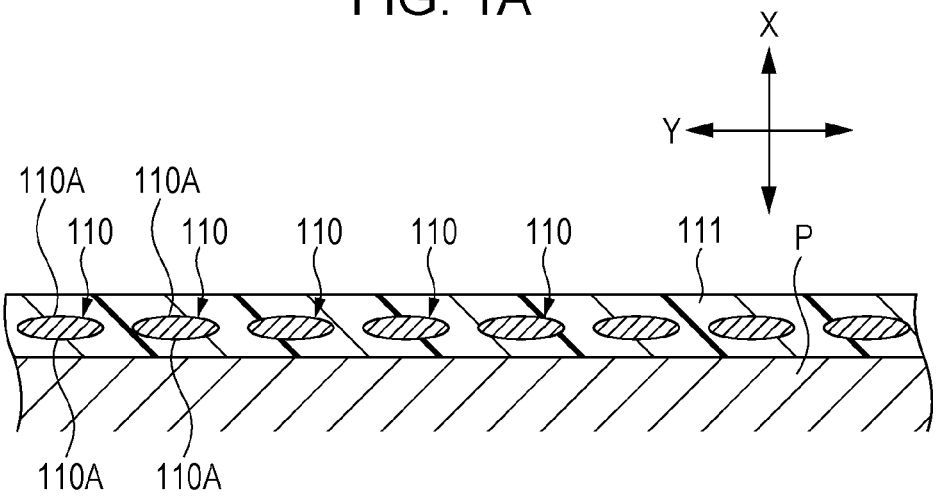
FIGS. 1A and 1B are each a cross-sectional view illustrating the posture of flat metallic pigment particles contained in a toner image formed by an image forming apparatus according to a first exemplary embodiment of the present invention, illustrated together with that according to a comparative example.

An image forming apparatus according to a first exemplary embodiment of the present invention will be described with reference to FIGS. 1 to 7. In the drawings, the arrow H indicates the vertical direction corresponding to the apparatus height direction, and the arrow W indicates the horizontal direction corresponding to the apparatus width direction.

<Overall Configuration of Image Forming Apparatus>

Figure 7:
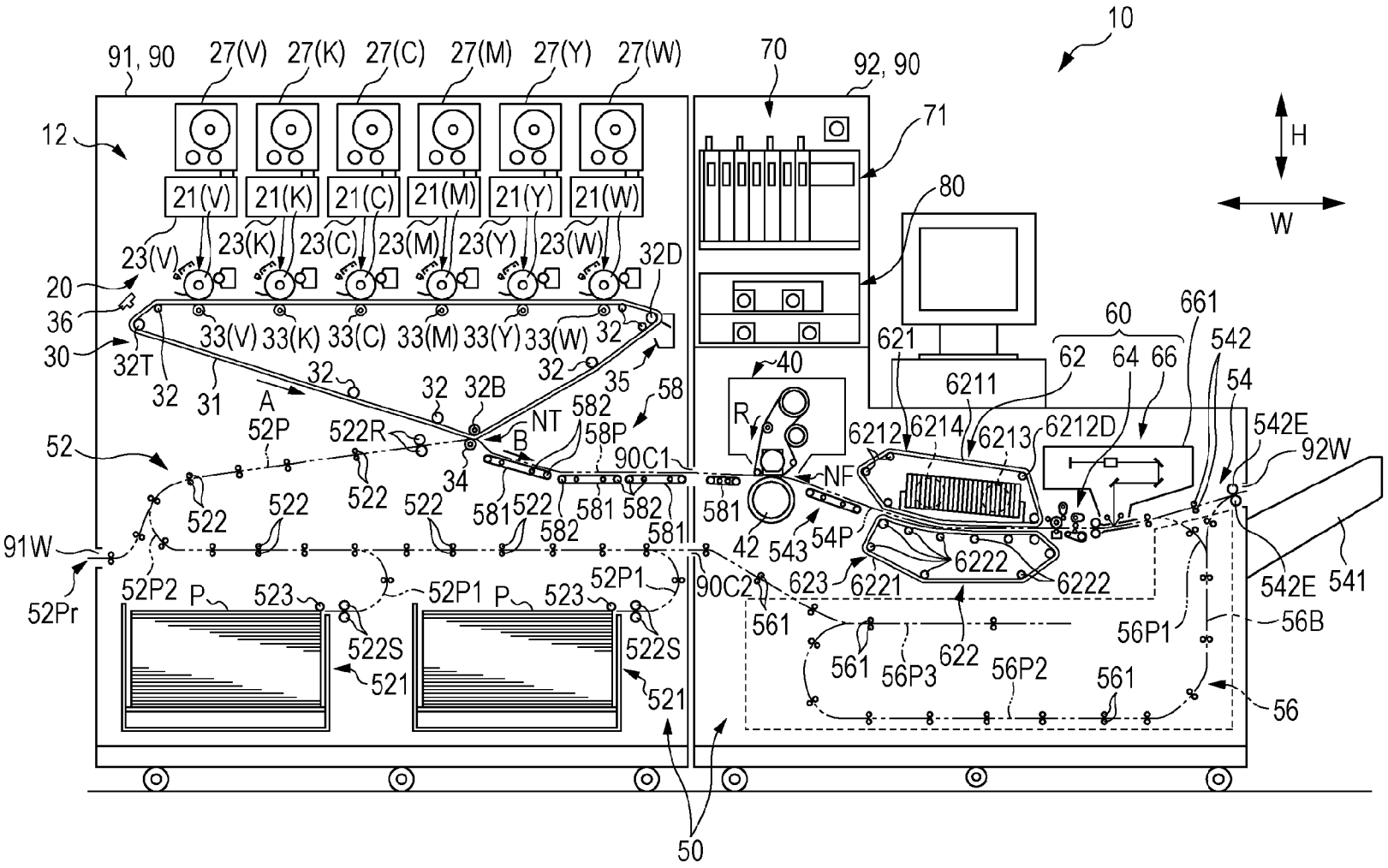
FIG. 7 illustrates a schematic configuration of the image forming apparatus according to the first exemplary embodiment of the present invention.

FIG. 7 is a schematic diagram illustrating an overall configuration of an image forming apparatus 10 as seen from the front side. As illustrated in the drawing, the image forming apparatus 10 includes an image forming section 12 that forms an image on a sheet member P that serves as a recording medium through an electrophotographic system, a medium transport device 50 that transports the sheet member P, and a post-processing section 60 that performs post-processing etc. on the sheet member P on which an image has been formed.

The image forming apparatus 10 also includes a controller 70 that controls the various sections discussed earlier and a power source section 80 to be discussed later, and the power source section 80 which supplies power to the various sections described above including the controller 70.

The image forming section 12 includes a toner image forming section 20 that forms a toner image, a transfer device 30 that transfers the toner image formed by the toner image forming section 20 to the sheet member P, and a fixing device 40 that fixes the toner image transferred to the sheet member P to the sheet member P.

The medium transport device 50 includes a medium supply section 52 that supplies the sheet member P to the image forming section 12, and a medium ejection section 54 that ejects the sheet member P on which the toner image has been formed. The medium transport device 50 also includes a medium return section 56 used to form an image on both surfaces of the sheet member P, and an intermediate transport section 58 to be discussed later.

The post-processing section 60 includes a medium cooling section 62 that cools the sheet member P to which the toner image has been transferred in the image forming section 12, a correction device 64 that corrects curl of the sheet member P, and an image inspection section 66 that inspects the image formed on the sheet member P. The various sections forming the post-processing section 60 are disposed in the medium ejection section 54 of the medium transport device 50.

The various sections of the image forming apparatus 10 are housed in a housing 90 except for an ejected medium receiving section 541 forming the medium ejection section 54 of the medium transport device 50. In the exemplary embodiment, the housing 90 is dividable into a first housing 91 and a second housing 92 that are adjacent to each other in the apparatus width direction. This reduces the transport size of the image forming apparatus 10 in the apparatus width direction.

The first housing 91 houses a principal portion of the image forming section 12 excluding the fixing device 40 to be discussed later, and the medium supply section 52. The second housing 92 houses the fixing device 40 forming the image forming section 12, the medium ejection section 54 excluding the ejected medium receiving section 541, the medium cooling section 62, the image inspection section 66, the medium return section 56, the controller 70, and the power source section 80. The first housing 91 and the second housing 92 are coupled to each other by a fastening unit such as a bolt and a nut (not illustrated), for example. With the first housing 91 and the second housing 92 coupled to each other, a communication opening portion 90C1 for the sheet member P that extends from a transfer nip NT to a fixing nip NF of the image forming section 12 to be discussed later and a communication passage 90C2 for the sheet member P that extends from the medium return section 56 to the medium supply section 52 are formed between the first housing 91 and the second housing 92.

(Image Forming Section)

As discussed earlier, the image forming section 12 includes the toner image forming section 20, the transfer device 30, and the fixing device 40. Plural toner image forming sections 20 are provided to form toner images in respective colors. In the exemplary embodiment, toner image forming sections 20 for six colors, namely a first special color (V), a second special color (W), yellow (Y), magenta (M), cyan (C), and black (K), are provided.

The symbols (V), (W), (Y), (M), (C), and (K) used in FIG. 7 indicate the respective colors described above. The transfer device 30 transfers toner images in the six colors from a transfer belt 31, to which the toner images in the six colors superimposed on each other have been transferred through a first transfer, to the sheet member P at the transfer nip NT.

In the exemplary embodiment, for example, the first special color (V) is a silver color for which a toner containing flat metallic pigment particles is used to impart a metallic luster to an image. Meanwhile, the second special color (W) is a corporate color specific to a user that is used frequently compared to the other colors. The details of the silver toner and control performed on the various portions by the controller 70 to form an image using toners in metallic colors (such as the silver color and a gold color, for example) will be discussed later.

[Toner Image Forming Section]

Figure 5:
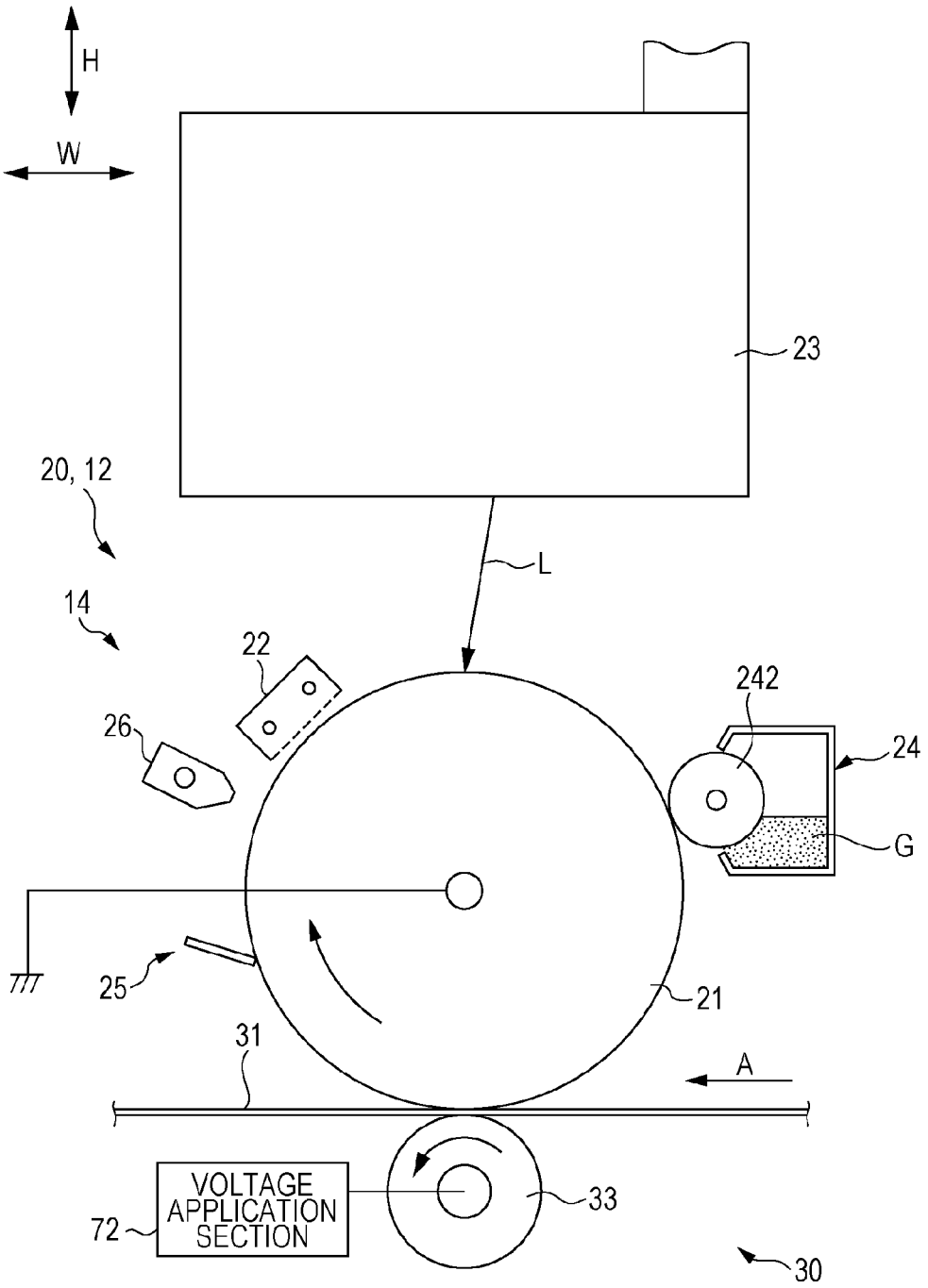
FIG. 5 is a side view illustrating a photosensitive drum etc. provided in the image forming apparatus according to the first exemplary embodiment of the present invention.

The toner image forming sections 20 for the respective colors are basically formed in the same manner except for the toners to be used. Thus, image forming units 14 for the respective colors will be described below without being specifically differentiated from each other. As illustrated in FIG. 5, the image forming unit 14 of the toner image forming section 20 includes a photosensitive drum 21 that serves as an example of an image holding element, a charging unit 22, an exposure device 23, a developing device 24 that serves as an example of a developing unit, a cleaning device 25, and a static eliminating device 26.

[Photosensitive Drum]

The photosensitive drum 21 is formed in a cylindrical shape, grounded, and driven by a drive unit (not illustrated) so as to rotate about its own axis. A photosensitive layer that provides a negative charging polarity, for example, is formed on the surface of the photosensitive drum 21. As illustrated in FIG. 7, the photosensitive drums 21 for the respective colors are disposed in line with each other along the apparatus width direction as seen from the front.

[Charging Unit]

As illustrated in FIG. 5, the charging unit 22 charges the surface (photosensitive layer) of the photosensitive drum 21 to a negative polarity. In the exemplary embodiment, the charging unit 22 is a scorotron charging unit of a corona discharge type (non-contact charging type).

[Exposure Device]

The exposure device 23 forms an electrostatic latent image on the surface of the photosensitive drum 21. Specifically, the exposure device 23 radiates modulated exposure light L to the surface of the photosensitive drum 21, which has been charged by the charging unit 22, in accordance with image data received from an image signal processing section 71 (see FIG. 7) that forms the controller 70. An electrostatic latent image is formed on the surface of the photosensitive drum 21 by the exposure light L radiated by the exposure device 23.

[Developing Device]

The developing device 24 develops the electrostatic latent image formed on the surface of the photosensitive drum 21 using a developer G containing a toner to form a toner image on the surface of the photosensitive drum 21. The developing device 24 is supplied with the toner from a toner cartridge 27 filled with the toner.

[Cleaning Device]

The cleaning device 25 is formed as a blade that scrapes off a toner that remains on the surface of the photosensitive drum 21 after the toner image is transferred to the transfer device 30 from the surface of the photosensitive drum 21.

[Static Eliminating Device]

The static eliminating device 26 eliminates static by radiating light to the photosensitive drum 21 after the transfer. This causes the charging history of the surface of the photosensitive drum 21 to be canceled.

[Transfer Device]

The transfer device 30 performs a first transfer of the toner images on the photosensitive drums 21 for the respective colors onto the transfer belt 31, which is an example of a transfer member, as superimposed on each other, and performs a second transfer of the superimposed toner images onto the sheet member P. The transfer device 30 will be specifically described below.

[Transfer Belt]

Figure 6:
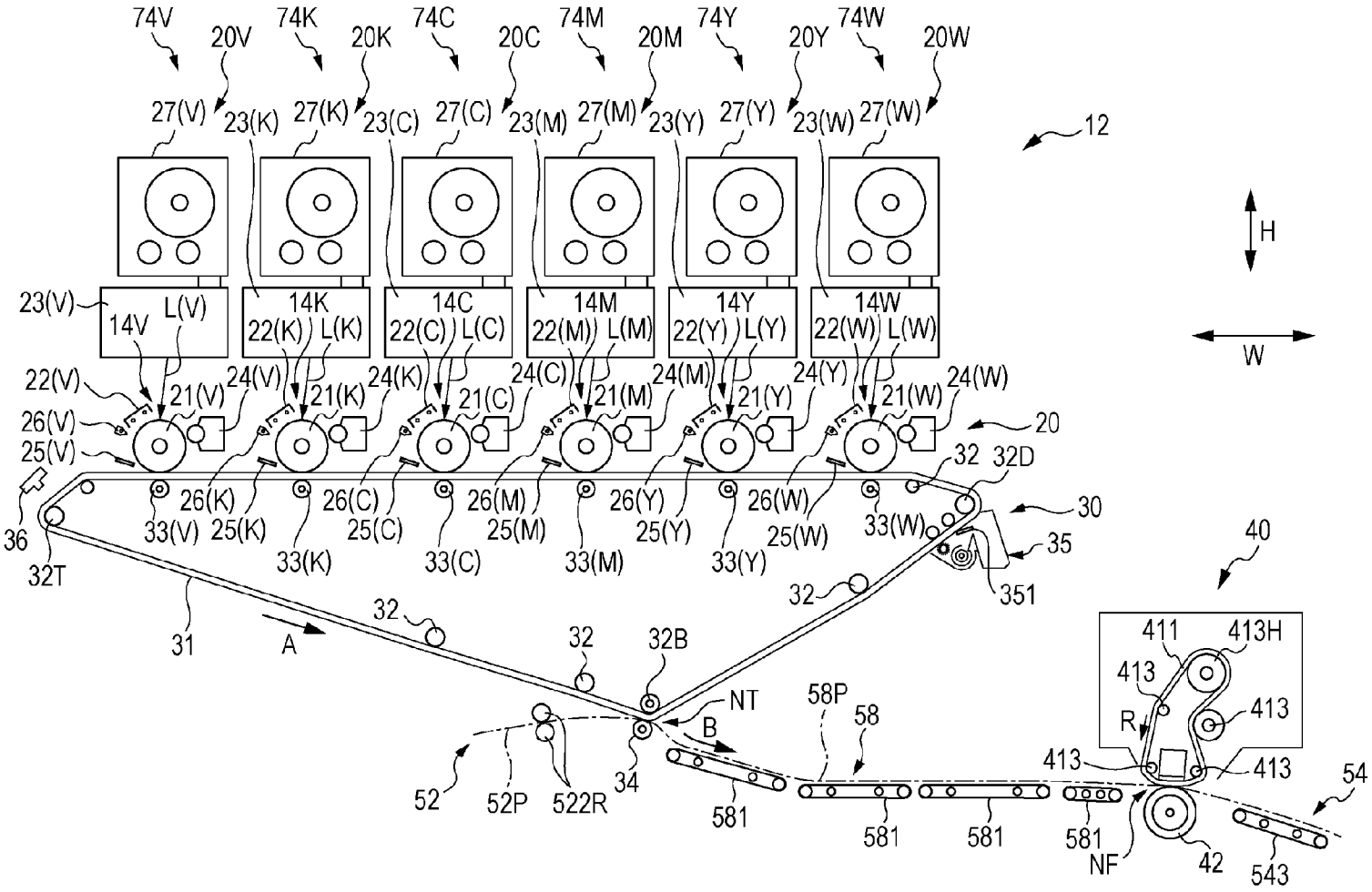
FIG. 6 illustrates the configuration of an image forming section provided in the image forming apparatus according to the first exemplary embodiment of the present invention.

As illustrated in FIG. 6, the transfer belt 31 has an endless shape, and is wound around plural rollers 32 to determine its posture. In the exemplary embodiment, the transfer belt 31 has a posture of an inverted obtuse triangle that is long in the apparatus width direction as seen from the front. Of the plural rollers 32, a roller 32D illustrated in FIG. 6 functions as a drive roller that applies power of a motor (not illustrated) to circulate the transfer belt 31 in the direction of the arrow A.

Of the plural rollers 32, a roller 32T illustrated in FIG. 6 functions as a tension applying roller that applies a tension to the transfer belt 31. Of the plural rollers 32, a roller 32B illustrated in FIG. 6 functions as a counter roller for a second transfer roller 34 to be discussed later. The lower-end vertex of the transfer belt 31, which forms the obtuse angle of the transfer belt 31 in the posture of an inverted obtuse triangle as discussed earlier, is wound around the roller 32B. The upper side of the transfer belt 31 which extends in the apparatus width direction with the transfer belt 31 in the posture discussed earlier contacts the photosensitive drums 21 for the respective colors from below.

[First Transfer Roller]

First transfer rollers 33 that serve as examples of a transfer member that transfers the toner image on each photosensitive drum 21 to the transfer belt 31 are disposed inside the transfer belt 31. The first transfer rollers 33 are disposed opposite to the photosensitive drums 21 for the corresponding colors across the transfer belt 31. The first transfer rollers 33 are applied with a transfer bias voltage that causes the toner images formed on the photosensitive drums 21 to be transferred to the transfer belt 31.

Specifically, a voltage application section 72 (see FIG. 5) is provided for each of the first transfer rollers 33 to apply a voltage to each of the first transfer rollers 33. The voltage application section 72 applies a transfer bias to the first transfer roller 33 so that a transfer current flows between the first transfer roller 33 and the photosensitive drum 21. The transfer current causes the toner image constituted from a toner charged to a negative polarity and formed on the photosensitive drum 21 to be transferred to the transfer belt 31. The current value of the transfer current is controlled through constant current control.

Thus, a transfer section 74V that serves as an example of a first transfer section that forms a toner image using a toner containing flat metallic pigment particles and that transfers the formed toner image to the transfer belt 31 through a transfer current includes a toner image forming section 20V and a first transfer roller 33V. Meanwhile, transfer sections 74K, 74C, 74M, 74Y, and 74W that serve as examples of a second transfer section that forms a toner image using a toner not containing flat metallic pigment particles and that transfers the formed toner image to the transfer belt 31 through a transfer current includes toner image forming sections 20K, 20C, 20M, 20Y, and 20W and first transfer rollers 33K, 33C, 33M, 33Y, and 33W, respectively.

[Second Transfer Roller]

The transfer device 30 also includes the second transfer roller 34 which serves as a medium transfer section that transfers the superimposed toner images on the transfer belt 31 to the sheet member P. The second transfer roller 34 is disposed with the transfer belt 31 interposed between the roller 32B and the second transfer roller 34 to form the transfer nip NT between the transfer belt 31 and the second transfer roller 34. The sheet member P is supplied to the transfer nip NT from the medium supply section 52 at an appropriate timing. The second transfer roller 34 is applied by a voltage application section 76 (see FIG. 4) with a transfer bias voltage that causes the toner images transferred to the transfer belt 31 to be transferred to the sheet member P. Application of the transfer bias voltage causes a transfer current to flow between the second transfer roller 34 and the roller 32B. The transfer current causes the toner images to be transferred from the transfer belt 31 to the sheet member P which passes through the transfer nip NT. The current value of the transfer current is controlled through constant current control.

[Cleaning Device]

The transfer device 30 further includes the cleaning device 35 which cleans the transfer belt 31 after the second transfer. The cleaning device 35 is disposed downstream of the location at which the second transfer is performed (the transfer nip NT) and upstream of the location at which the first transfer is performed in the circulation direction of the transfer belt 31. The cleaning device 35 includes a blade 351 that scrapes off a toner that remains on the surface of the transfer belt 31 from the surface of the transfer belt 31.

[Fixing Device]

As illustrated in FIG. 6, the fixing device 40 fixes the toner images transferred to the sheet member P in the transfer device 30 to the sheet member P. In the exemplary embodiment, the fixing device 40 is configurated to fix the toner images to the sheet member P by heating and pressurizing the toner images at the fixing nip NF formed by a fixing belt 411 wound around plural rollers 413 and a pressurizing roller 42. A roller 413H serves as a heating roller that includes a built-in heater, for example, and that is rotated by a drive force transmitted from a motor (not illustrated). This causes the fixing belt 411 to be circulated in the direction of the arrow R.

The pressurizing roller 42 is also rotated by a drive force transmitted from a motor (not illustrated) at a peripheral velocity that is generally the same as the peripheral velocity of the fixing belt 411.

(Medium Transport Device)

As illustrated in FIG. 7, the medium transport device 50 includes the medium supply section 52, the medium ejection section 54, the medium return section 56, and the intermediate transport section 58.

[Medium Supply Section]

The medium supply section 52 includes a container 521 that stores the sheet members P stacked on each other. In the exemplary embodiment, two containers 521 are disposed side by side along the apparatus width direction below the transfer device 30.

A medium supply passage 52P is formed by plural transport roller pairs 522, guides (not illustrated), and so forth to extend from each container 521 to the transfer nip NT as the second transfer position. The medium supply passage 52P is turned back in the apparatus width direction at two turning portions 52P1 and 52P2 while being raised to form a shape that leads to the transfer nip NT (a generally "S" shape).

A feed roller 523 that feeds the uppermost one of the sheet members P stored in the container 521 is disposed on the upper side of each container 521. Of the plural transport roller pairs 522, a transport roller pair 522S on the most upstream side in the transport direction of the sheet member P functions as separation rollers that separate the sheet members P fed from the container 521 by the feed roller 523 in a superposed state from each other. Of the plural transport roller pairs 522, a transport roller pair 522R positioned immediately upstream of the transfer nip NT in the transport direction of the sheet member P operates such that the timing of movement of the toner images on the transfer belt 31 and the timing of transport of the sheet member P match each other.

The medium supply section 52 includes a preliminary transport passage 52Pr. The preliminary transport passage 52Pr starts at an opening portion 91W of the first housing 91 provided opposite to the second housing 92 to be merged with the turning portion 52P2 of the medium supply passage 52P. The preliminary transport passage 52Pr serves as a transport passage that feeds the sheet member P fed from an optional recording medium supply device (not illustrated) disposed adjacent to the opening portion 91W of the first housing 91 to the image forming section 12.

[Intermediate Transport Section]

As illustrated in FIG. 6, the intermediate transport section 58 is disposed to extend from the transfer nip NT of the transfer device 30 to the fixing nip NF of the fixing device 40, and includes plural belt transport members 581 that each include an endless transport belt wound around rollers.

The intermediate transport section 58 transports the sheet member P by circulating the transport belt with the belt transport members 581 suctioning air (to generate a negative pressure) to draw the sheet member P to the surface of the transport belt.

[Medium Ejection Section]

As illustrated in FIG. 7, the medium ejection section 54 ejects the sheet member P to which the toner images have been fixed by the fixing device 40 of the image forming section 12 to the outside of the housing 90 from an ejection port 92W formed at an end portion of the second housing 92 opposite to the first housing 91.

The medium ejection section 54 includes an ejected medium receiving section 541 that receives the sheet member P ejected from the ejection port 92W.

The medium ejection section 54 has a medium ejection passage 54P through which the sheet member P is transported from the fixing device 40 (the fixing nip NF) to the ejection port 92W. The medium ejection passage 54P is formed from a belt transport member 543, plural roller pairs 542, guides (not illustrated), and so forth. Of the plural roller pairs 542, a roller pair 542E disposed on the most downstream side in the ejection direction of the sheet member P functions as ejection rollers that eject the sheet member P onto the ejected medium receiving section 541.

[Medium Return Section]

The medium return section 56 includes plural roller pairs 561. The plural roller pairs 561 form a reverse passage 56P to which the sheet member P having passed through the image inspection section 66 is fed in the case where there is a request to form an image on both surfaces of the sheet member P. The reversal passage 56P has a branch path 56P1, a transport path 56P2, and a reverse path 56P3. The branch path 56P1 is branched from the medium ejection passage 54P. The transport path 56P2 feeds the sheet member P received from the branch path 56P1 to the medium supply passage 52P. The reverse path 56P3 is provided in the middle of the transport path 56P2, and reverses the front and back sides of the sheet member P by changing the transport direction of the sheet member P transported through the transport path 56P2 into the opposite direction (through switchback transport).

(Post-Processing Section)

The medium cooling section 62, the correction device 64, and the image inspection section 66 which form the post-processing section 60 are disposed on a portion of the medium ejection passage 54P of the medium ejection section 54 provided upstream of the branch portion of the branch path 56P1 in the ejection direction of the sheet member P, and arranged sequentially in the order in which they are mentioned from the upstream side in the ejection direction.

[Medium Cooling Section]

The medium cooling section 62 includes a heat absorbing device 621 that absorbs heat of the sheet member P, and a pressing device 622 that presses the sheet member P against the heat absorbing device 621. The heat absorbing device 621 is disposed on the upper side of the medium ejection passage 54P. The pressing device 622 is disposed on the lower side of the medium ejection passage 54P.

The heat absorbing device 621 includes an endless heat absorbing belt 6211, plural rollers 6212 that support the heat absorbing belt 6211, a heat sink 6213 disposed on the inner side of the heat absorbing belt 6211, and a fan 6214 that cools the heat sink 6213.

The outer peripheral surface of the heat absorbing belt 6211 contacts the sheet member P so as to be able to exchange heat with the sheet member P. Of the plural rollers 6212, a roller 6212D functions as a drive roller that transmits a drive force to the heat absorbing belt 6211. The heat sink 6213 makes slidable surface contact with the inner peripheral surface of the heat absorbing belt 6211 over a predetermined range along the medium ejection passage 54P.

The pressing device 622 includes an endless pressing belt 6221, and plural rollers 6222 that support the pressing belt 6221. The pressing belt 6221 is wound around the plural rollers 6222. The pressing device 622 transports the sheet member P together with the heat absorbing belt 6211 while pressing the sheet member P against the heat absorbing belt 6211 (the heat sink 6213).

[Correction Device]

The correction device 64 is provided downstream of the medium cooling section 62 in the medium ejection section 54. The correction device 64 corrects curl of the sheet member P received from the medium cooling section 62.

[Image Inspection Section]

An in-line sensor 661 that forms a principal portion of the image inspection section 66 is disposed downstream of the correction device 64 in the medium ejection section 54. The in-line sensor 661 detects the presence or absence of, and the degree of, a defect in toner concentration, an image defect, a defect in image position, and so forth of the fixed toner image on the basis of light radiated to the sheet member P and reflected from the sheet member P.

<Image Forming Operation (Effect) of Image Forming Apparatus>

Next, an overview of an image forming process and a post-processing process performed on the sheet member P by the image forming apparatus 10 will be described.

As illustrated in FIG. 7, when an image forming instruction is received, the controller 70 actuates the toner image forming section 20, the transfer device 30, and the fixing device 40. This rotates the photosensitive drum 21 of the image forming unit 14 and a developing roller 242 of the developing device 24 for each color to circulate the transfer belt 31 as illustrated in FIG. 6. This also rotates the pressurizing roller 42 to circulate the fixing belt 411. In synchronization with these operations, the controller 70 further actuates the medium transport device 50 and so forth.

This causes the photosensitive drum 21 for each color to be charged by the charging unit 22 while being rotated. The controller 70 sends image data which have been subjected to image processing performed by the image signal processing section to each exposure device 23. The exposure device 23 outputs exposure light L in accordance with the image data to expose the charged photosensitive drum 21 to the light. Then, an electrostatic latent image is formed on the surface of the photosensitive drum 21. The electrostatic latent image formed on the photosensitive drum 21 is developed using a developer supplied from the developing device 24. Consequently, a toner image in the corresponding color among the first special color (V), the second special color (W), yellow (Y), magenta (M), cyan (C), and black (K) is formed on the photosensitive drum 21 for each color.

The toner images in the respective colors formed on the photosensitive drums 21 for the respective colors are sequentially transferred to the circulating transfer belt 31 by applying a transfer bias voltage through the first transfer rollers 33 for the respective colors. This causes a superimposed toner image obtained by superimposing the toner images in the six colors to be formed on the transfer belt 31. The superimposed toner image is transported to the transfer nip NT by the circulation of the transfer belt 31.

As illustrated in FIG. 7, the sheet member P is supplied to the transfer nip NT by the transport roller pair 522R of the medium supply section 52 at a timing that matches the transport of the superimposed toner image. Application of the transfer current at the transfer nip NT causes the superimposed toner image to be transferred from the transfer belt 31 to the sheet member P.

The sheet member P to which the toner image has been transferred is transported by the intermediate transport section 58 from the transfer nip NT of the transfer device 30 to the fixing nip NF of the fixing device 40. The fixing device 40 applies heat and a pressure to the sheet member P passing through the fixing nip NF. This causes the transferred toner image to be fixed to the sheet member P.

The sheet member P ejected from the fixing device 40 is processed by the post-processing section 60 while being transported by the medium ejection section 54 to the ejected medium receiving section 541 outside the apparatus. The sheet member P heated in the fixing process is first cooled in the medium cooling section 62. Then, the sheet member P is corrected for its curl by the correction device 64. The image inspection section 66 detects the presence or absence of, and the degree of, a defect in toner concentration, an image defect, a defect in image position, and so forth of the toner image fixed to the sheet member P. The sheet member P is ejected to the medium ejection section 54.

Meanwhile, in the case where an image is to be formed on a non-image surface of the sheet member P on which no image is formed (in the case of double-sided printing), the controller 70 switches the transport passage for the sheet member P after passing through the image inspection section 66 from the medium ejection passage 54P of the medium ejection section 54 to the branch path 56P1 of the medium return section 56. This causes the sheet member P to be fed to the medium supply passage 52P with its front and back sides reversed by way of the reverse passage 56P. An image is formed (fixed) on the back surface of the sheet member P in the same process as the image forming process performed on the front surface discussed earlier. The sheet member P is ejected by the medium ejection section 54 to the ejected medium receiving section 541 outside the apparatus through the same process as the process performed after an image is formed on the front surface discussed earlier.

<Configuration of Principal Portion>

Next, the positions at which the transfer sections 74 for the respective colors are disposed, a metallic toner 112 used for the first special color (V), control performed by the controller 70 to transfer the toner images formed on the photosensitive drums 21 to the transfer belt 31, and so forth will be described.

(Arrangement of Transfer Sections)

As illustrated in FIG. 6, the transfer sections 74K, 74C, 74M, 74Y, and 74W are disposed upstream of the transfer section 74V which uses the metallic toner and downstream of the second transfer roller 34 in the circulation direction of the transfer belt 31. In other words, the transfer section 74V is disposed downstream of the transfer sections 74 for the other colors in the circulation direction of the transfer belt 31.

Therefore, the charge amount of the metallic toner 112 is not increased through passage through the transfer sections 74 for the other colors.

(Toner)

Figure 4:
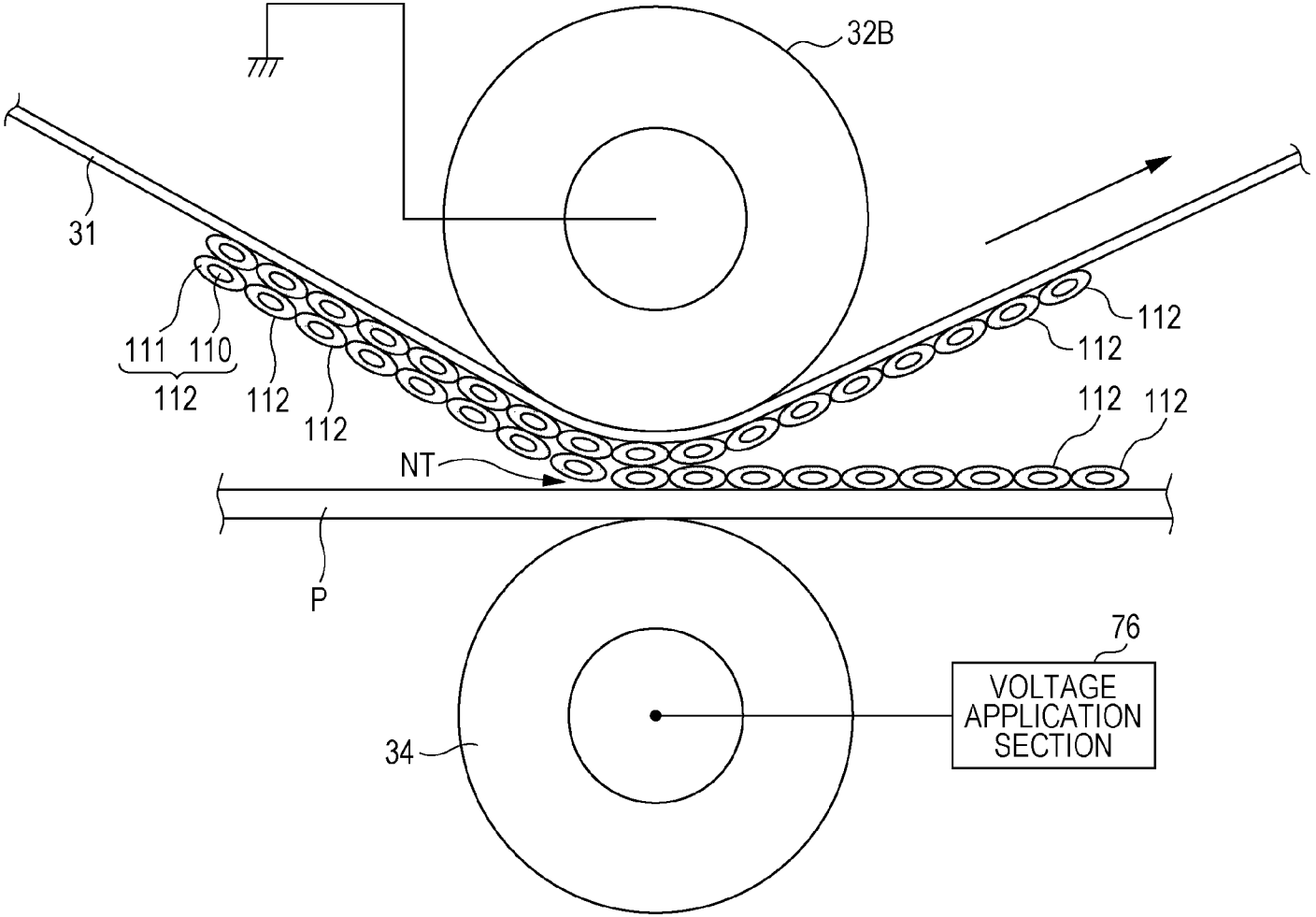
FIG. 4 is a front view illustrating a portion of the image forming apparatus according to the first exemplary embodiment of the present invention in the vicinity of a second transfer roller.

As illustrated in FIG. 4, the metallic toner 112 used for the first special color (V) contains pigment particles 110 that serve as examples of flat metallic pigment particles, and binder resins 111 that encapsulate the pigment particles 110, and is used to impart a metallic luster to an image. Examples of the image imparted with a metallic luster include an image formed using the metallic toner 112 and toners in colors other than the silver color, and an image formed using only the metallic toner 112.

The pigment particles 110 are made of aluminum. As illustrated in FIG. 3B, the pigment particles 110 are shaped such that, when placed on a flat surface and seen from a side, their dimension in the horizontal direction in the drawing is larger than their dimension in the vertical direction in the drawing.

Figure 3A:
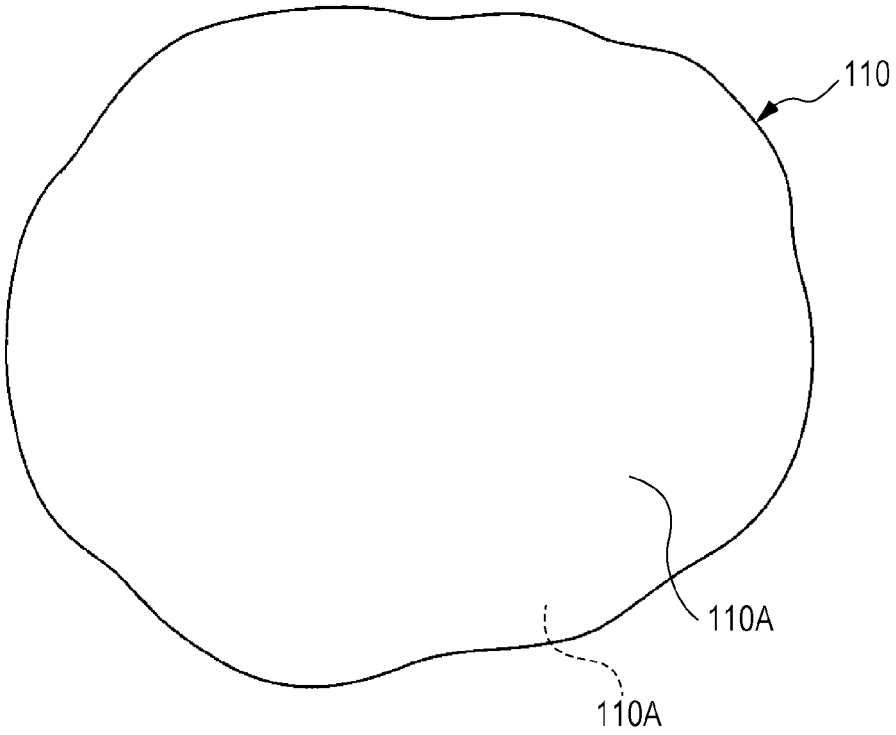
FIGS. 3A and 3B are a plan view and a side view, respectively, of a flat metallic pigment particle contained in a toner used by the image forming apparatus according to the first exemplary embodiment of the present invention.
Figure 3B:
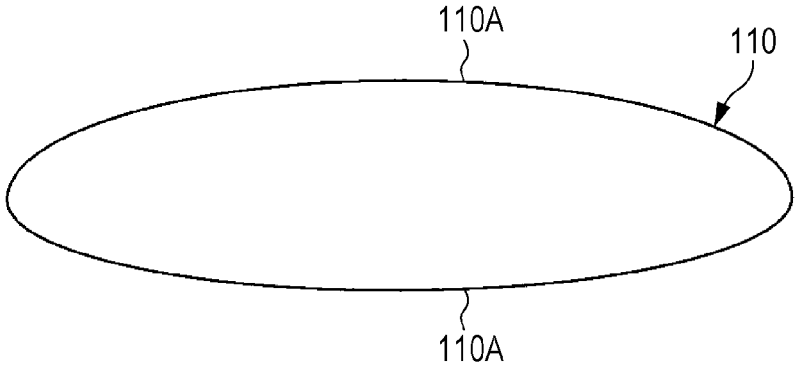

When the pigment particle 110 illustrated in FIG. 3B is seen from the upper side in the drawing, the pigment particle 110 has a more spread shape as illustrated in FIG. 3A than its shape as seen from a side. The pigment particle 110 has a pair of reflective surfaces 110A (flat surfaces) that face upward and downward with the pigment particle 110 placed on a flat surface (see FIG. 3B). Consequently, the pigment particles 110 have a flat shape.

On the other hand, toners in colors other than the silver color (hereinafter occasionally referred to simply as "toners in the other colors") that are used for the second special color (W), yellow (Y), magenta (M), cyan (C), and black (K) contain pigment particles not containing flat metallic pigment particles (for example, an organic pigment and an inorganic pigment) and binder resins.

(Controller)

The controller 70 controls the voltage application sections 72 for the respective colors such that the transfer current for the first transfer roller 33V is smaller than the transfer currents for the first transfer rollers 33K, 33C, 33M, 33Y, and 33W for the other colors.

<Effect of Principal Portion>

Next, the effect of the principal portion will be described.

When an image forming instruction is received to impart a metallic luster to at least a part of an image, the controller 70 causes the metallic toner image forming section 20V to operate (see FIG. 6).

Specifically, an electrostatic latent image corresponding to a portion of the image to which a metallic luster is to be imparted is formed on the surface of a photosensitive drum 21V. That is, in the case where a metallic luster is to be imparted to the entire surface of the sheet member P, an electrostatic latent image is formed on the entire surface of the photosensitive drum 21V. In the case where a metallic luster is to be imparted to a part of the surface of the sheet member P, an electrostatic latent image is formed on the corresponding portion of the surface of the photosensitive drum 21V.

The electrostatic latent image formed on the photosensitive drum 21V is developed using a developer containing a metallic toner 112 supplied from a developing device 24V. This causes a metallic toner image to be formed on the photosensitive drum 21V.

After the toner images in the other colors are transferred to the transfer belt 31, the metallic toner image is transferred to the circulating transfer belt 31.

Specifically, as discussed earlier, the transfer current which flows between the first transfer roller 33 and the photosensitive drum 21 causes the toner image constituted from a toner charged to a negative polarity to be transferred to the transfer belt 31 by an electrostatic force.

As discussed earlier, the silver transfer section 74V is disposed downstream of the transfer sections 74 for the other colors in the circulation direction of the transfer belt 31. Thus, the metallic toner image formed from the metallic toner 112 and transferred to the transfer belt 31 does not pass through the transfer sections 74 for the other colors. Therefore, the charge amount of the metallic toner 112 is not increased compared to a case where such an image passes through the transfer sections 74 for the other colors.

Further, the controller 70 controls the voltage application sections 72 for the respective colors such that the transfer current which flows through the first transfer roller 33V for the silver color is smaller than the transfer currents which flow through the first transfer rollers 33 for the other colors. For example, the transfer current which flows through the first transfer roller 33V is 22.5 [pA], and the transfer currents which flow through the first transfer rollers 33 for the other colors are 45 [pA].

Therefore, an increase in charge amount of the toner caused by the transfer current is smaller for the metallic toner 112 than for the toners in the other colors. Further, as discussed earlier, the charge amount of the metallic toner 112 is not increased through passage through the transfer sections 74 for the other colors. This makes the charge amount of the metallic toner 112 constituting the metallic toner image before being transferred to the sheet member P smaller than the charge amount of the toners in the other colors.

This causes a superimposed toner image obtained by superimposing the toner images in the six colors to be formed on the transfer belt 31. The superimposed toner image (hereinafter referred to simply as a "toner image") is transferred from the transfer belt 31 to the sheet member P at the transfer nip NT. Specifically, the toner image is transferred from the transfer belt 31 to the sheet member P at the transfer nip NT by the transfer current which flows through the second transfer roller 34.

Since the charge amount of the metallic toner 112 is smaller than the charge amount of the toners in the other colors, a large amount of metallic toner (retransfer toner) remains on the transfer belt 31 as illustrated in FIG. 4. This makes the layer of the toner image constituted from the metallic toner 112 transferred onto the sheet member P thin (for example, single-layered).

The adhesion that acts between particles of the metallic toner 112 transferred to the transfer belt 31 is lower than the adhesion between the metallic toner 112 and the transfer belt 31. Therefore, an upper side of the metallic toner 112, which is stacked on the transfer belt 31 in an overlapping manner, preferentially remains on (adheres to) the transfer belt 31. This makes the layer of the toner image constituted from the metallic toner 112 transferred to the sheet member P thin. That is, the overlapping metallic toner 112 is removed from the sheet member P, and the toner image constituted from the metallic toner 112 tends to be single-layered (the metallic toner 112 which reduces a metallic luster remains on the transfer belt 31 to be removed from the sheet member P).

As illustrated in FIG. 6, the sheet member P to which the toner image has been transferred is transported by the intermediate transport section 58 from the transfer nip NT of the transfer device 30 to the fixing nip NF of the fixing device 40. The fixing device 40 applies heat and a pressure to the sheet member P passing through the fixing nip NF. This causes the transferred toner image to be fixed to the sheet member P.

A comparison is made between an example in which a layer of a toner image constituted from the metallic toner 112 transferred onto the sheet member P is thin and a comparative example in which a layer of a toner image constituted from the metallic toner 112 transferred onto the sheet member P is thick.

Figure 1B:
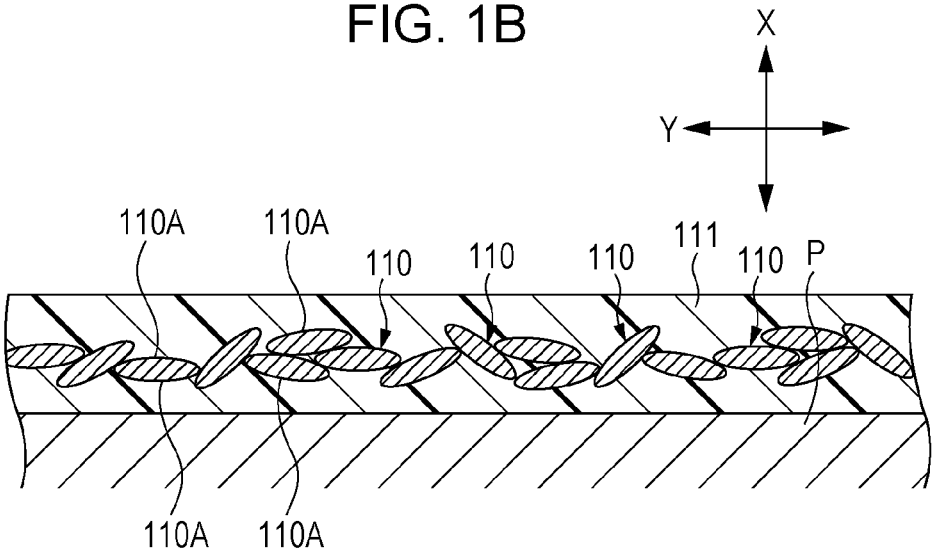

FIG. 1A illustrates a cross section according to the example with the toner image fixed to the sheet member. FIG. 1B illustrates a cross section according to the comparative example with the toner image fixed to the sheet member.

In the comparative example, as illustrated in FIG. 1B, the layer of the toner image fixed to the sheet member P is thick. Therefore, the amount of the pigment particles 110 contained in the toner per unit area is so large that the pigment particles 110 overlap each other with the reflective surfaces 110A facing in different directions.

In the example, in contrast, as illustrated in FIG. 1A, the layer of the toner image fixed to the sheet member P is thin. Therefore, the pigment particles 110 contained in the toner are prevented from overlapping each other. Therefore, when a pressure is applied during passage through the fixing nip NF, the reflective surfaces 110A of the pigment particles 110 face in the direction orthogonal to the sheet surface of the sheet member P (in the X direction in the drawing).

Figure 2:
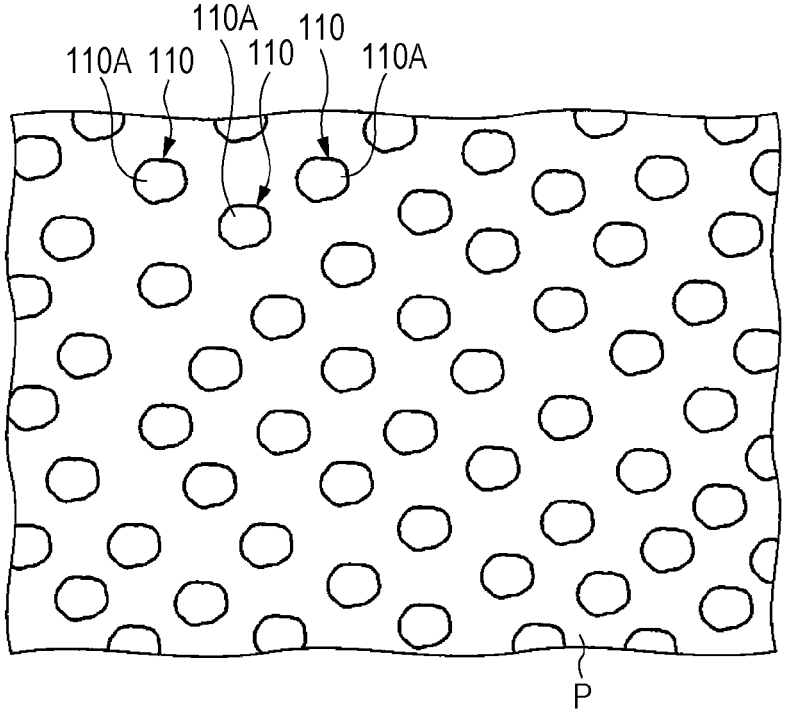
FIG. 2 is a plan view illustrating the posture of the flat metallic pigment particles contained in the toner image formed by the image forming apparatus according to the first exemplary embodiment of the present invention.

The pigment particles 110 are arranged in the direction along the sheet surface of the sheet member P (in the Y direction in the drawing). In other words, the flat pigment particles 110 constituting the toner image are brought into a posture in which the reflective surfaces 110A of the pigment particles 110 extend along the sheet surface of the sheet member P. As illustrated in FIG. 2, the pigment particles 110 are distributed evenly on the sheet member P, compared to the comparative example discussed earlier, with the reflective surfaces 110A facing in the direction orthogonal to the sheet surface.

As described above, the silver transfer section 74V is disposed downstream of the transfer sections 74 for the other colors in the circulation direction of the transfer belt 31, and the transfer current which flows through the first transfer roller 33V is smaller than the transfer currents which flow through the first transfer rollers 33 for the other colors. This makes the charge amount of the metallic toner 112 smaller than the charge amount of the toners in the other colors, which makes the layer of the toner image constituted from the metallic toner 112 transferred onto the sheet member P thin.

In addition, the layer of the toner image constituted from the metallic toner 112 transferred onto the sheet member P is thin. Thus, the pigment particles 110 which are flat and constitute a metallic toner image are arranged such that the reflective surfaces 110A of the pigment particles 110 extend along the sheet surface of the sheet member P.

Second Exemplary Embodiment

Figure 8:
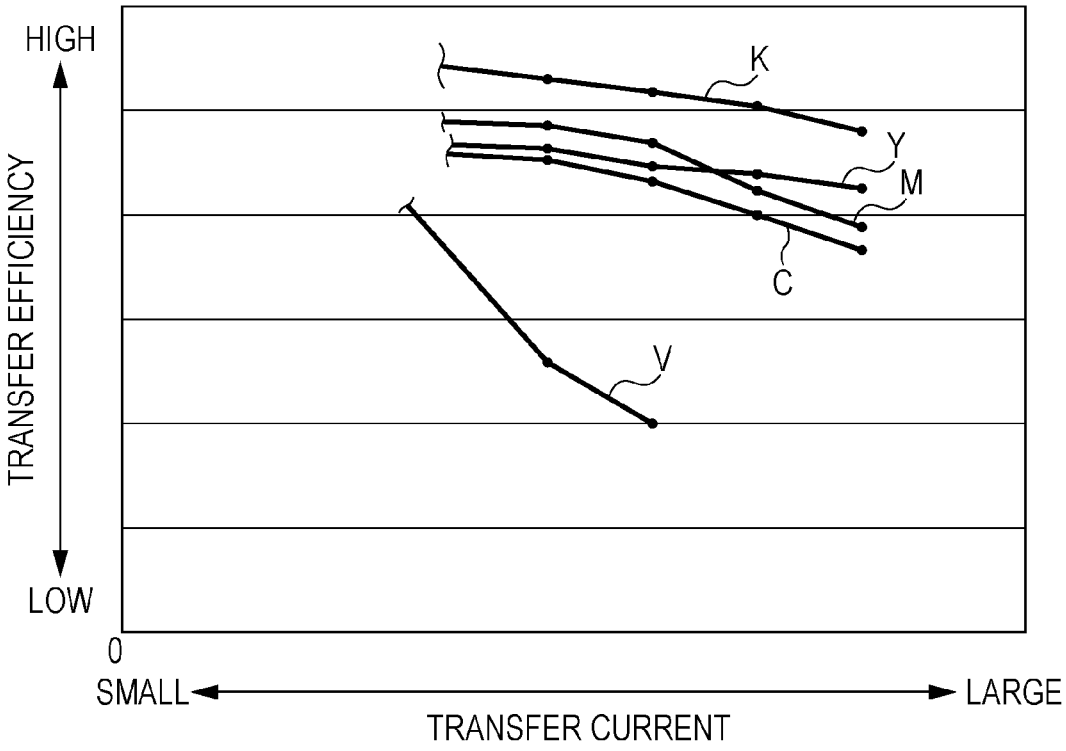
FIG. 8 is a graph used to illustrate the effect of the image forming apparatus according to a second exemplary embodiment of the present invention.

Next, an image forming apparatus according to a second exemplary embodiment of the present invention will be described with reference to FIG. 8. Components that are the same as those according to the first exemplary embodiment are denoted by the same reference symbols to omit description thereof, and components that are not described in relation to the first exemplary embodiment will be principally described.

In the second exemplary embodiment, the second transfer roller 34 transfers a toner image to the sheet member P (see FIG. 6) through such a transfer current that makes the transfer efficiency (second transfer efficiency) at which the toner image formed by the silver transfer section 74V is transferred to the sheet member P lower than the transfer efficiency at which the toner images formed by the transfer sections 74 for the other colors are transferred to the sheet member P.

Specifically, the controller 70 controls the voltage application section 76 to control the transfer current which flows through the second transfer roller 34 (see FIG. 4).

The graph illustrated in FIG. 8 will be described. In the graph, the horizontal axis represents the transfer current which flows through the second transfer roller 34, and the vertical axis represents the transfer efficiency at which the toner image is transferred to the sheet member P. The graph indicates the relationship between the transfer current and the transfer efficiency for black (K), cyan (C), magenta (M), yellow (Y), and silver (V).

As seen from the graph, the transfer efficiency of the toner image constituted by the metallic toner 112 is significantly affected by the magnitude of the transfer current compared to the toner images in the other colors. Consequently, the transfer efficiency at which the toner image formed by the silver transfer section 74V is transferred to the sheet member P is made lower than the transfer efficiency at which the toner images formed by the transfer sections 74 for the other colors are transferred to the sheet member P by controlling (selecting) the transfer current which flows through the second transfer roller 34.

The method of calculating the transfer efficiency discussed earlier will be described below.

1. Transfer Efficiency of Toner not Containing Flat Metallic Pigment Particles

The concentration D1 of an image on the recording paper and the concentration D2 of an image that remains on the transfer belt are measured using a reflection densitometer (X-Rite 938 manufactured by X-Rite Incorporated), and substituted into the following formula (A) to obtain the transfer efficiency.

$$\text{Transfer efficiency}=\{D1/(D1+D2)\}\times 100(\%) \qquad \text{Formula (A)}$$

2. Transfer Efficiency of Toner Containing Flat Metallic Pigment Particles (1) The toner remaining on the transfer belt is tape-transferred onto black paper using a transparent tape.

(2) The lightness L* of the portion to which the toner has been tape-transferred is measured using a fluorescence spectrodensitometer (FD-7 manufactured by Konica Minolta Incorporated), converted into a toner mass per unit area, and substituted into the "mass per unit area of toner on belt after second transfer" in the following formula (B).

(3) The mass of the toner on the transfer belt before the second transfer is measured, and substituted into the "mass per unit area of toner on belt before second transfer" in the following formula (B).

$$\text{Transfer efficiency}=(1-(\text{mass per unit area of toner on belt after second transfer})/(\text{mass per unit area of toner on belt before second transfer})\times 100[\%] \qquad \text{Formula (B)}$$

While specific exemplary embodiments of the present invention have been described in detail above, the present invention is not limited to such exemplary embodiments. It is apparent to those skilled in the art that a variety of other exemplary embodiments may fall within the scope of the present invention. For example, in the exemplary embodiments, plural transfer sections 74 for the other colors are provided. However, there may be one (a single) transfer section 74 for another color.

What is claimed is:

1. An image forming apparatus comprising:

an endless transfer member configured such that an image is transferred to the transfer member during circulation of the transfer member;

a first transfer section configured to form an image using a toner containing flat metallic pigment particles, and to transfer the formed image to the transfer member through a transfer current;

a second transfer section configured to form an image using a toner not containing flat metallic pigment particles, and to transfer the formed image to the transfer member through a transfer current, the second transfer section being disposed upstream of the first transfer section in a circulation direction of the transfer member; and a medium transfer section configured to transfer the image transferred to the transfer member to a recording medium through a transfer current, wherein the transfer current for the first transfer section is smaller than the transfer current for the second transfer section.

2. The image forming apparatus according to claim 1, wherein the medium transfer section is configured to transfer an image to a recording medium through such a transfer current that makes a transfer efficiency at which the image transferred by the first transfer section is transferred to the recording medium lower than a transfer efficiency at which the image transferred by the second transfer section is transferred to the recording medium.

* * * * *